US006507316B2

(12) United States Patent
Mendelsohn et al.

(10) Patent No.: US 6,507,316 B2
(45) **Date of Patent: *Jan. 14, 2003**

(54) METHOD FOR MOUNTING PATCH ANTENNA

(75) Inventors: Joseph P. Mendelsohn, Englishtown, NJ (US); Richard F. Schwartz, Cranbury, NJ (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/470,202

(22) Filed: Dec. 21, 1999

(65) Prior Publication Data

US 2002/0000934 A1 Jan. 3, 2002

(51) Int. Cl.[7] ..... H01Q 1/32
(52) U.S. Cl. ..... 343/700 MS; 343/848
(58) Field of Search ..... 343/700 MS, 702, 343/846, 848, 829

(56) References Cited

U.S. PATENT DOCUMENTS

| | | | | | |
|---|---|---|---|---|---|
| 5,019,829 | A | * | 5/1991 | Heckman et al. | 343/700 MS |
| 5,291,210 | A | * | 3/1994 | Nakase | 343/700 MS |
| 5,892,482 | A | * | 4/1999 | Coleman et al. | 343/700 MS |
| 5,912,647 | A | * | 6/1999 | Tsuru et al. | 343/700 MS |
| 5,949,376 | A | * | 9/1999 | McDonald et al. | 343/700 MS |
| 6,002,367 | A | * | 12/1999 | Engblom et al. | 343/700 MS |
| 6,034,636 | A | * | 3/2000 | Saltoh | 343/700 MS |
| 6,246,368 | B1 | * | 6/2001 | Deming et al. | 343/700 MS |

* cited by examiner

*Primary Examiner*—Tan Ho
*Assistant Examiner*—Shih-Chao Chen
(74) *Attorney, Agent, or Firm*—Woodbridge & Associates, PC

(57) ABSTRACT

This invention relates to an improved design and method of manufacture of patch antenna assemblies which incorporates projections, or tabs, to the sides of the antenna patches to facilitate mounting to the antenna structure, thereby reducing the total number of parts used in the antenna assembly.

5 Claims, 3 Drawing Sheets

METHOD FOR MOUNTING PATCH ANTENNA

BACKGROUND OF THE INVENTION

1. Field of the Invention

This invention relates to a patch antenna structure, and a method of construction thereof.

2. Description of Related Art

The uses of antennas continue to increase with reductions in antenna size and cost, and the development of complimentary microwave designs. For size reduction, "patch" antennas are of particular interest. Patch antennas generally comprise a dielectric substrate, an electrically conductive ground layer disposed below the dielectric substrate, and an electrically conductive patch antenna element disposed over the dielectric substrate. The patch antenna element may be coupled to an RF feed means using any of several conventional methods such as a coaxial cable. A multiple frequency antenna may be constructed by "stacking" patch elements with intermediate dielectric layers.

Typical prior art methods of mounting the patch antenna over the dielectric substrate employ a frame mechanism to hold the patches. Alternative methods have patches etched on a printed circuit board, which itself requires a support structure. Accordingly, these and other prior art methods typically rely on screws, plastic inserts or mounting frames for attaching the patch antenna, using manual assembly techniques.

SUMMARY OF THE INVENTION

This invention relates to an improved patch antenna assembly which reduces the cost of manufacturing antennas by reducing or eliminating extra parts used to hold the patches. This is accomplished by reducing the number of patch elements by forming them from a single metal sheet thereby allowing machine assembly and corresponding reductions in assembly time.

These and other features of the invention will be more fully understood by reference to the following drawings.

DETAILED DESCRIPTION OF THE INVENTION

During the course of this description, like numbers will be used to identify like elements according to different figures which illustrate the invention.

The present invention relates to a change to the design of antenna "patches", which are radiating elements used in a class of antennas known as patch antennas. In the preferred embodiment of the present invention, these patches are placed directly onto parts of the antenna, such as the feed networks, without any of the intervening support mechanisms that are required in prior art patch antenna assemblies. This is accomplished by incorporating projections, or tabs, at the sides of the antenna patches to facilitate mounting to the antenna structure. Use of these tabs reduces the total number of parts used in the antenna assembly. Further, these tabs simplify assembly of the antenna structure as the length of the tabs can be used to set the height of the patch above the dielectric substrate. In addition, this tab feature readily permits patches to be connected together in a series arrangement.

Consequently, this design allows the patches/antenna to be combined with a printed circuit board used for purposes besides that needed by the antenna; e.g., the patches and antenna could be combined into the printed circuit board used by radio circuits. Also, the entire antenna assembly can now be performed by using the same surface mount production equipment as is used for standard assembly of other printed circuit boards.

Figure 1:
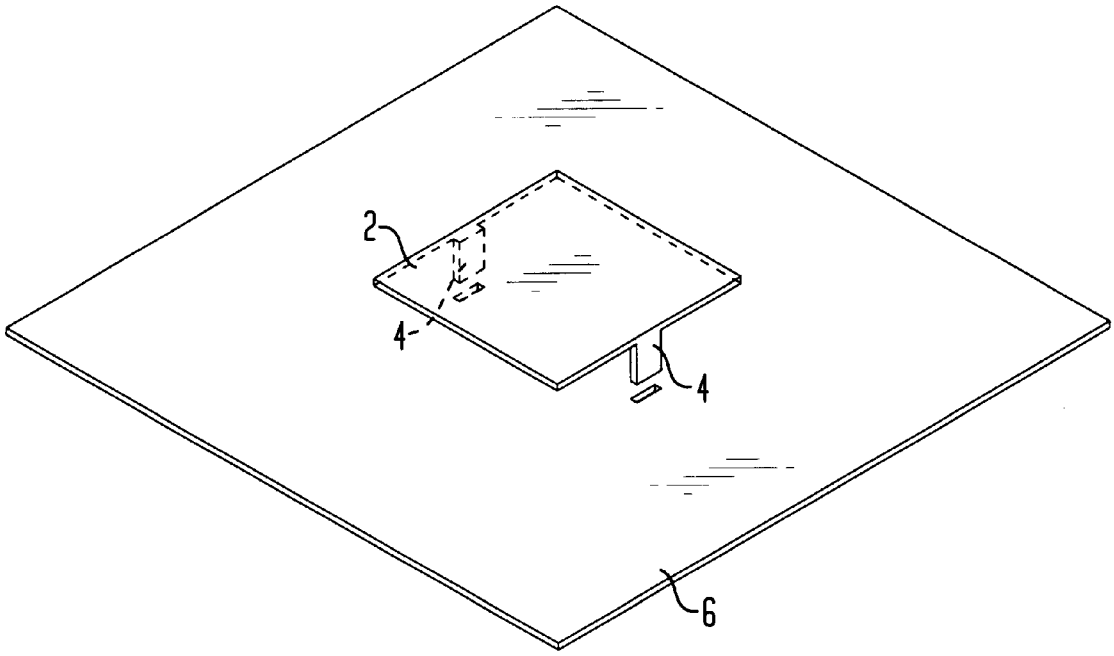
FIG. 1 illustrates an antenna patch with fold down tabs according to the preferred embodiment of the invention.

FIG. 1 illustrates an antenna patch 2 with fold down tabs 4 according to the preferred embodiment of the present invention. The patch can be stamped and formed out of sheet metal. The folded down tabs interlock with a PCB or other distribution structure 6. Use of such patch tabs to install the antenna patch in this manner takes advantage of the voltage null in the middle plane of the patch and accordingly, does not appreciably impact on the performance of the resulting antenna assembly.

Figure 2A:
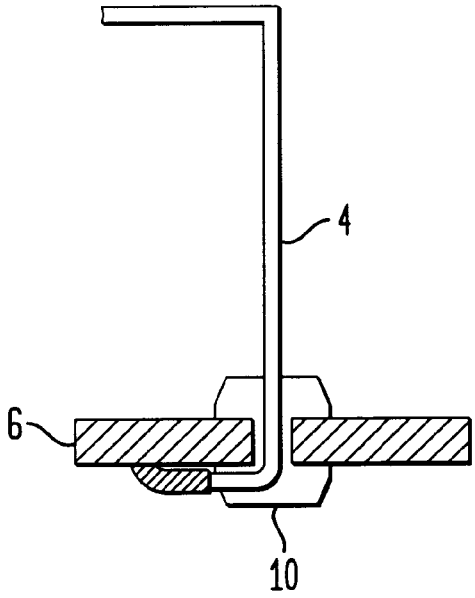
FIGS. 2A and 2B illustrate alternative tab snap locking features.
Figure 2B:
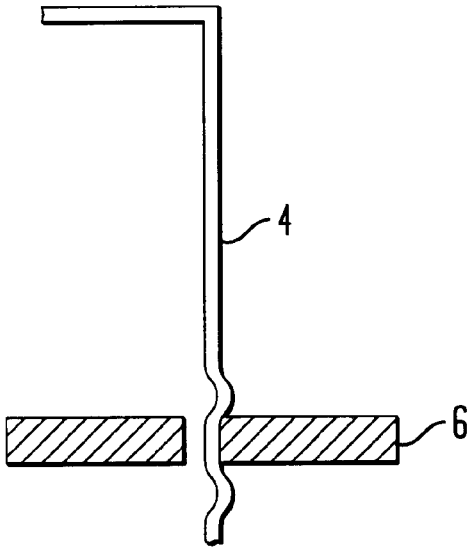

The tabs 4 can be held with an interlock feature, soldered, welded or held with adhesive epoxy or plastic. FIGS. 2A and 2B illustrate two such interlock features. FIG. 2A depicts a locking attachment wherein a soldered connection 10 is made between the tab 4 and the PCB 6. An alternative locking arrangement is illustrated in FIG. 2B, which incorporates a snap arrangement which does not require the use of solder.

For soldered applications, the patches could be left on the surface of the PCB 6 without through holes and accordingly, can be produced using a standard surface mount technology (SMT) assembly line. For example, patches can be installed in tape and reel feeders and placed automatically on the PCB. Such SMT technology greatly reduces manufacturing costs.

Figure 3:
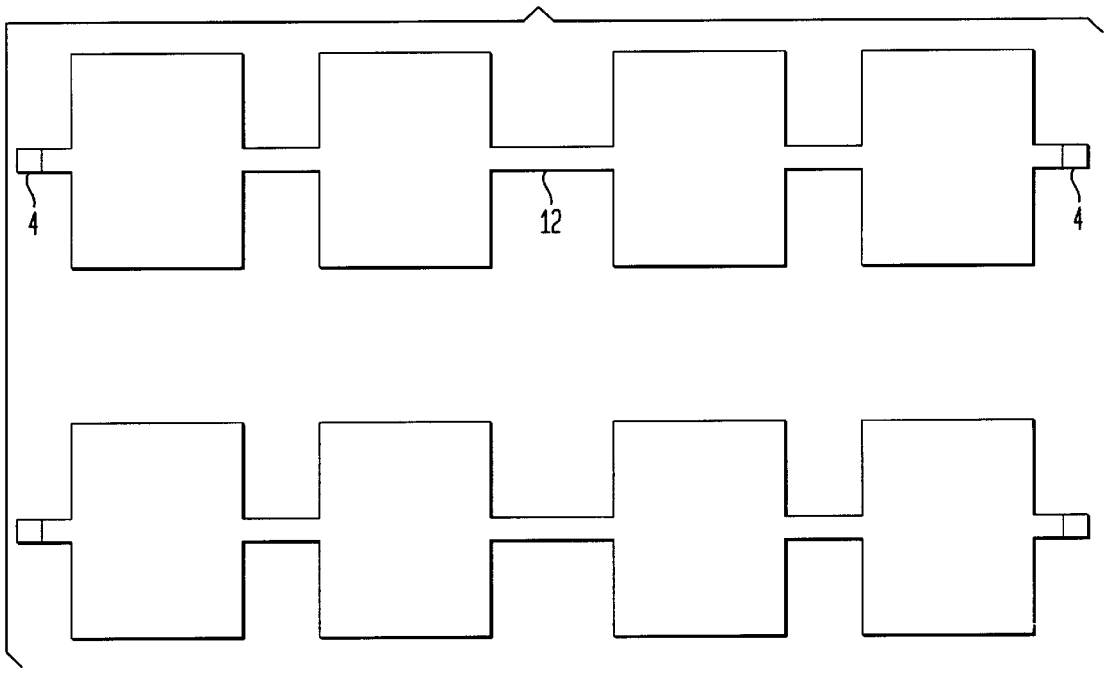
FIG. 3 depicts an exemplary sheet pattern for a 2×4 array.
Figure 4:
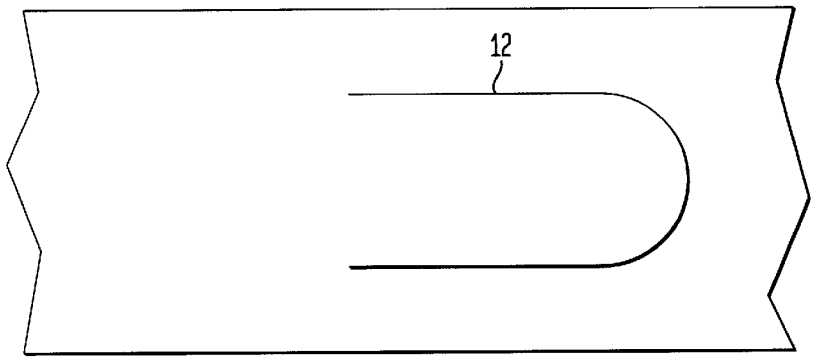
FIG. 4 depicts greater detail of a tab element of FIG. 3.

As depicted in FIG. 3, arrays of antennas, which include the locking features of the present invention, can be stamped from a single sheet. In such an arrangement, the tabs appearing at the ends of the array are the same tabs 4 previously discussed above. Tabs 12 which appear in between patch elements would, in the preferred embodiment, be stamped in a U-shaped fashion as depicted in FIG. 4. Accordingly, these tabs could then be folded and utilized in same manner as tabs 4 while the structural integrity of the antenna array is maintained.

While the invention has been described with reference to the preferred embodiment thereof, it will be appreciated by those of ordinary skill in the art that various modifications can be made to the structure and function of the individual parts of the system without departing from the spirit and scope of the invention as a whole.

We claim:

1. A printed circuit board having a surface containing one or more patch antennas:

said one or more patch antennas formed from sheet metal in a predetermined planar configuration with generally diametrically opposed fold down tabs that are bent perpendicular to said planar configuration, and each terminating at an end portion engaged with said printed circuit board proximate the location on said printed circuit board surface of each of said patch antennas;

each of said end portions of each of said fold down tabs extend generally parallel with said planar configuration of said patch antenna and contact said surface of said printed circuit board; and, means securing each of said end portions of said fold down tabs to said printed circuit board so that said planar configuration is generally parallel to said surface of said printed circuit board to define said patch antenna.

2. The apparatus of claim 1 wherein:

said end portions are secured to said surface of said printed circuit board by solder.

3. A process for manufacturing a printed circuit board containing one or more patch antenna structures comprising the steps of, irrespective of sequence:

providing one or more patch antennas, each formed from sheet metal and having a predetermined planar configuration and a plurality of fold down tabs that have each been bent perpendicular to said planar configuration and terminate at an end portion for engagement with said printed circuit board;

providing a printed circuit board having a surface containing one or more locations for said patch antenna;

positioning one or more patch antennas relative to said printed circuit board surface in each location for said patch antenna on said printed circuit board in a manner where said end portions of said fold down tabs contact said printed circuit board;

said end portions of said fold down tabs are formed to extend generally parallel with said planar configuration of said patch antenna; and, securing said end portions of said fold down tabs of each patch antenna to said printed circuit board at a predetermined distance of said planar configuration of said patch antenna from said surface of said printed circuit board to define said patch antenna on said printed circuit board.

4. The process of claim 3 wherein:

said securing is accomplished by (SMT), standard surface mount technology.

5. The process of claim 3 wherein said one or more patch antennas each include at least two spaced planar configurations interconnected by a tab portion and said fold down tabs support each of said planar configurations from at least two generally diametrically opposed positions to maintain each of said planar configurations at said predetermined distance from said surface of said printed circuit board; and further wherein a tab between two of said planar configurations is formed to include a "U" shaped fold down tab that is perpendicular to said planar configuration and having an end portion for engagement with said printed circuit board.

* * * * *